US005099806A

United States Patent [19]

Murata et al.

[11] Patent Number: 5,099,806

[45] Date of Patent: Mar. 31, 1992

[54] VALVE SYSTEM FOR AUTOMOBILE ENGINE

[75] Inventors: Shinichi Murata; Noboru Nakamura; Michiyasu Yoshida, all of Kyoto, Japan

[73] Assignee: Mitsubishi Jidosha Kogyo Kabushiki Kaisha, Tokyo, Japan

[21] Appl. No.: 725,606

[22] Filed: Jul. 3, 1991

[30] Foreign Application Priority Data

Jul. 10, 1990 [JP] Japan ..... 2-182131
Jul. 10, 1990 [JP] Japan ..... 2-182132

[51] Int. Cl.[5] ..... F01L 1/34; F01L 1/18

[52] U.S. Cl. ..... 123/90.16; 123/90.41; 123/198 F

[58] Field of Search ..... 123/90.15, 90.16, 90.39, 123/90.41, 90.44, 198 F

[56] References Cited

U.S. PATENT DOCUMENTS 4,724,802 2/1988 Ishii ..... 123/90.16
4,768,475 9/1988 Ikemura ..... 123/90.16
4,844,023 7/1989 Konno et al. ..... 123/90.16
4,848,285 7/1989 Konno ..... 123/90.16
4,883,027 11/1989 Oikawa et al. ..... 123/90.16

*Primary Examiner*—E. Rollins Cross
*Assistant Examiner*—Weilun Lo

[57] ABSTRACT

A valve system for an automobile engine opens and closes intake and exhaust valves by reciprocative force of a crankshaft. Specifically, the valve system controls timing for operating and stopping these valves, and the amount of cam lift. The valve system comprises a camshaft, a rocker shaft in parallel to the camshaft, a main rocker arm mounted on the rocker shaft, a sub-rocker arm pivotally supported on the rocker shaft, engaging means for engaging and disengaging the rocker shaft with and from the sub-rocker arm, and driving means for driving the engaging means. The engaging means includes an opening on a rotating surface of the sub-rocker arm, a plunger located in the rocker shaft and an oil chamber located at an upper or lower end of the plunger. The driving means includes an oil gallery in the rocker shaft and an oil pressuring member.

9 Claims, 17 Drawing Sheets

VALVE SYSTEM FOR AUTOMOBILE ENGINE

BACKGROUND OF THE INVENTION

1. Field of the Invention

This invention relates to a valve system for an automobile engine, and more particularly to a mechanism for driving a rocker arm of a valve system for an OHC type engine.

2. Description of the Related Art

As is wellknown, with a valve system for an OHC (overhead camshaft) type engine, one end of a seesaw rocker arm is in contact with a driving cam and the other end is in contact with valve stem ends to open and close valves in response to the movement of the cam.

With such a valve system, there have been proposed mechanisms for selectively stopping operation of valves and cylinders to save fuel during low speed and low load running, and for operating the valves efficiently to enhance air intake and gas exhaust during high speed running.

FIG. 26 of the accompanying drawings is a cross-sectional view showing a structure of one example of the foregoing mechanism for stopping reciprocation of valves. In FIG. 26, a reciprocative plunger C is located at a non-rocking portion of a rocker arm A. The plunger C confronts a stop plate D which is movable perpendicularly to the moving direction of the plunger C and has a circular opening D1 at the center thereof as shown in FIG. 27. The plunger C is passable through the opening D1. In FIG. 26, I stands for a rocker shaft.

One end of the stop plate D is coupled to a piston E, which is slidable perpendicularly in the moving direction of the plunger C above the rocking center of the rocker arm A. The piston E is driven by pressure in an oil gallery F connected to a non-illustrated oil pressure controller.

Normally, bias of compression springs G and H causes the plunger C to project toward the valve stem end B, and the piston E to prevent the center of the circular opening D1 of the stop plate P from being in agreement with an axis of the plunger C. (Refer to Column on "3. Valve Stopping Unit", page 161 of "Structure of Gasoline Engine", published by Sankaido Co., Ltd., for example.)

With the foregoing structure, during low speed and low load running, pressured oil from the oil pressure controller causes the piston E to slide to the right against the bias of the compression spring H as shown in FIG. 28. In response to the piston E, the stop plate D is moved to the right, thereby letting the circular opening D1 of the stop plate D agree with the axis of the plunger C. When the rocker arm A is rocked by the valve driving cam (by an angle $\theta$ shown in FIG. 28), rocking motion of the rocker arm A is not transmitted to the plunger C. Therefore, the valve stem end B is not reciprocated, thereby preventing the valves from being opened and closed.

With the foregoing structure, the valve driving mechanism as well as the plunger C for reciprocating the valve stem is disposed at the rocking portion which is far from the base of the rocker arm. Heavy weight is applied to the rocking portion of the rocker arm, which increases inertia mass, and makes the rocker arm rather slow to operate the valves efficiently during high speed running.

Since various components are mounted at the rocking portion of the rocker arm, the rocking portion becomes inevitably complicated. When this structure is applied to a valve system for a DOHC (double overhead camshaft) type engine in which valves are disposed side by side, it is impossible to achieve the primary object to reduce fuel cost and improve air intake and gas exhaust efficiency because of lack of a space for the above-described mechanism.

SUMMARY OF THE INVENTION

It is therefore an object of this to provide a valve system which can solve the inconveniences experienced with conventional valve systems by a simple structure and improve operation timing of the valves during high speed running.

Another object of this invention is to provide a valve system having a simple structure to prevent increase of the inertia mass applied to a rocker arm.

According to this invention, there is provided a valve system for an automobile, comprising: a camshaft; a plurality of valves for opening and closing intake ports of engine cylinders; a cam mounted on the camshaft for driving the valves; a rocker shaft pivotally mounted on an engaging housing and disposed adjacent to the camshaft; a main rocker arm fixedly mounted on the rocker shaft, one end of the main rocker arm being disposed against stems of the valves; a sub-rocker arm pivotally mounted on the rocker shaft, one end of the sub-rocker arm being normally biased to be in sliding contact with the cam by a biasing means, and the sub-rocker arm being rockable in response to movement of the cam; engaging means for engaging and disengaging the rocker shaft with and from the sub-rocker; and driving means for driving the engaging means depending upon an operating condition of the engine to engage and disengage the rocker shaft with and from the sub-rocker arm.

The camshaft includes a low speed cam and a high speed cam having different profiles, and the sub-rocker arm includes a low speed rocker arm being rockable in response to the movement of the low speed cam and a high speed cam being rockable in response to the movement of the high speed cam.

At a high engine speed, the engaging means engages the high speed rocker arm with the rocker shaft to drive the valves in response to the movement of the high speed cam. At a low engine speed, the engaging means engages the low speed rocker arm with the rocker shaft and disengages the high speed rocker arm from the rocker shaft to drive the valves in response to the movement of the low speed cam. And at a low engine speed and low load, the engaging means disengages the high speed rocker arm and the low speed rocker arm from the rocker shaft to stop the valves.

The engaging means includes an engaging hole which is on a rotating surface of the sub-rocker arm for angularly moving the rocker shaft, a through hole which is in the rocker shaft and is perpendicular to the axial direction of the rocker shaft and of which central axis coincides with the central axis of the engaging hole when a base circle of the cam is in sliding contact with the sub-rocker arm, and a plunger which is movable between a position in the through hole and a position projecting in the engaging hole and is engaged in the engaging hole when both of the central axes are in agreement.

The driving means includes an oil gallery in the rocker shaft in the axial direction thereof, and oil pressuring means for applying oil pressure to the plunger via the oil gallery to operate the plunger and to engage and disengage the rocker shaft with and from the sub-rocker arm.

The engaging means further includes a large diameter portion of the through hole of the rocker shaft, the large diameter portion being located near the bottom of the through hole and being larger in diameter than the engaging hole of the sub-rocker arm, a flange mounted on the plunger at a position opposite to the engaging hole and being movable in the large diameter portion of the through hole of the rocker shaft, a convex member located at the bottom of the plunger, and a spring mounted around the plunger in a space between the flange and the large diameter portion and adapted to bias the plunger to keep the flange in the large diameter portion of the through hole.

The driving means further includes an oil chamber located in the large diameter portion of the through hole of the rocker shaft, and an oil path of the flange, the oil being to introduce oil from the oil gallery to the oil chamber.

The engaging means further includes a spring mounted round the plunger at an end opposite to the engaging hole and adapted to bias the plunger to project the plunger into the engaging hole.

The driving means further includes an oil passage which is located in the plunger and has an end open at an upper portion of the plunger and the other end open on a side of the plunger to introduce oil from the oil gallery to a space between the engaging hole and a surface of the plunger in the engaging hole.

The oil pressure means includes a pressure oil pump for generating high pressure oil, a path for supplying the high pressure oil to the oil gallery in the rocker shaft, an oil pressure controller located in the high pressure oil supplying path to supply and interrupt oil to and from the oil gallery, and a relief valve for releasing pressure of oil when oil pressure in the high pressure oil supplying path between the oil pressure controller and the pressure oil pump exceeds a predetermined value.

The oil pressure controller comprises a solenoid valve for selecting a first position for supplying the high pressure oil from the pressure oil pump to the oil gallery or a second position for connecting the oil gallery to a low pressure oil tank, a solenoid for activating the solenoid valve to select any of the two positions, and a computer for operating the solenoid according to an engine speed and load.

The sub-rocker arm has at its one end a roller bearing which is in sliding contact with the cam.

With this arrangement, it is possible to reduce the inertia mass of the rocker arm to decrease fuel cost and improve opening and closing timing of the valves during high speed running.

Selective operation of the high speed cam or low speed cam can enhance high engine output in the entire engine speed range.

Further, a simple structure enables cost reduction for manufacturing the valve system.

DETAILED DESCRIPTION

A valve system according to a first embodiment of this invention will be described with reference to FIG. 1 through FIG. 13.

Figure 1:
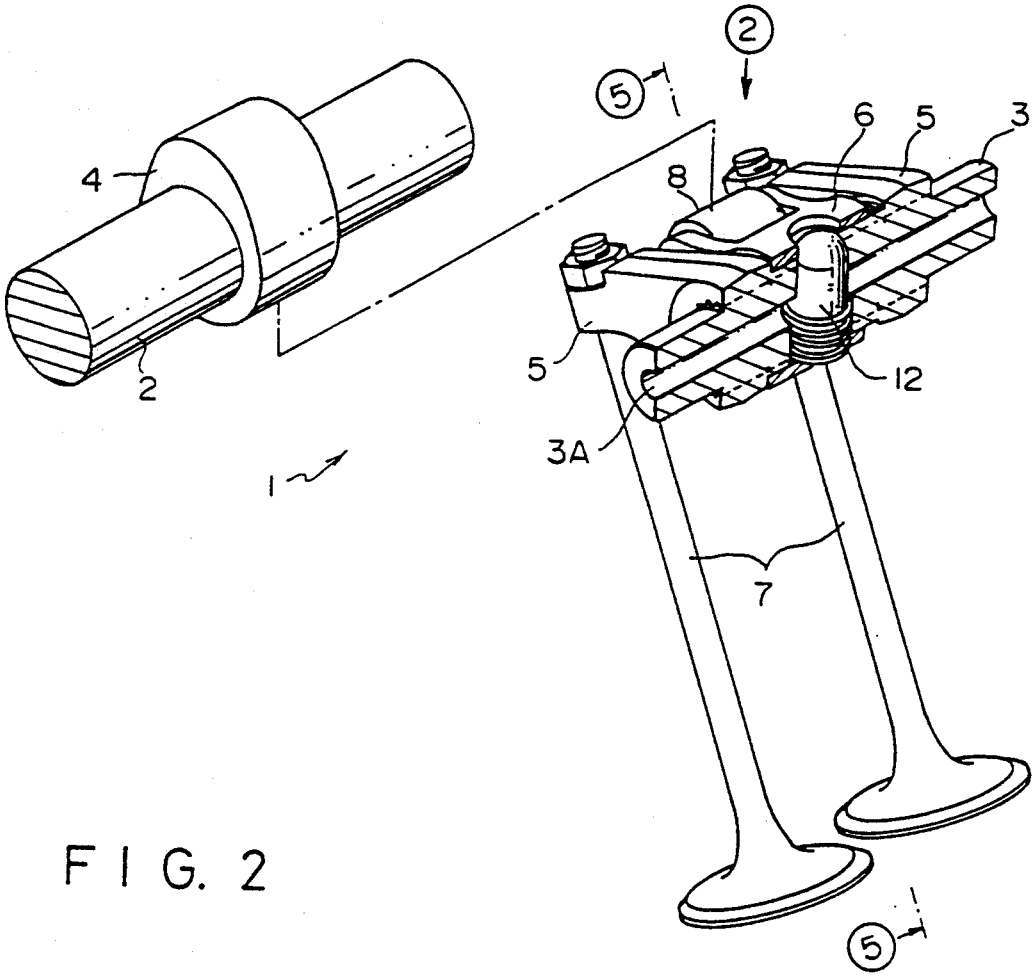
FIG. 1 is a perspective view, partially in cross section, of a valve system according to a first embodiment of this invention applied to a DOCH type engine.

As shown in FIG. 1, the valve system 1 comprises a camshaft 2 and a rocker shaft 3, both of which are pivotally mounted on an engine housing. The camshaft 2 has a valve driving cam 4 fixed thereon.

Figure 2:
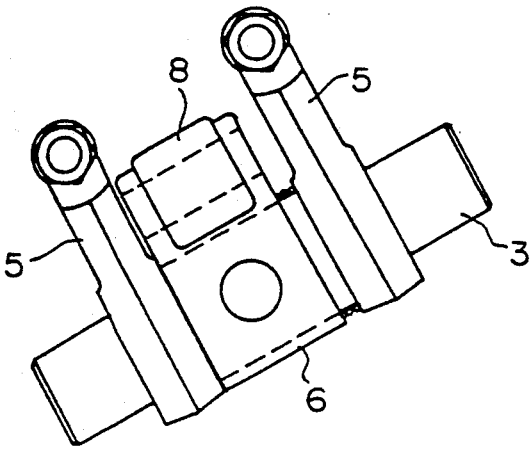
FIG. 2 is a plan view observed from the direction (2) of FIG. 1.
Figure 3:
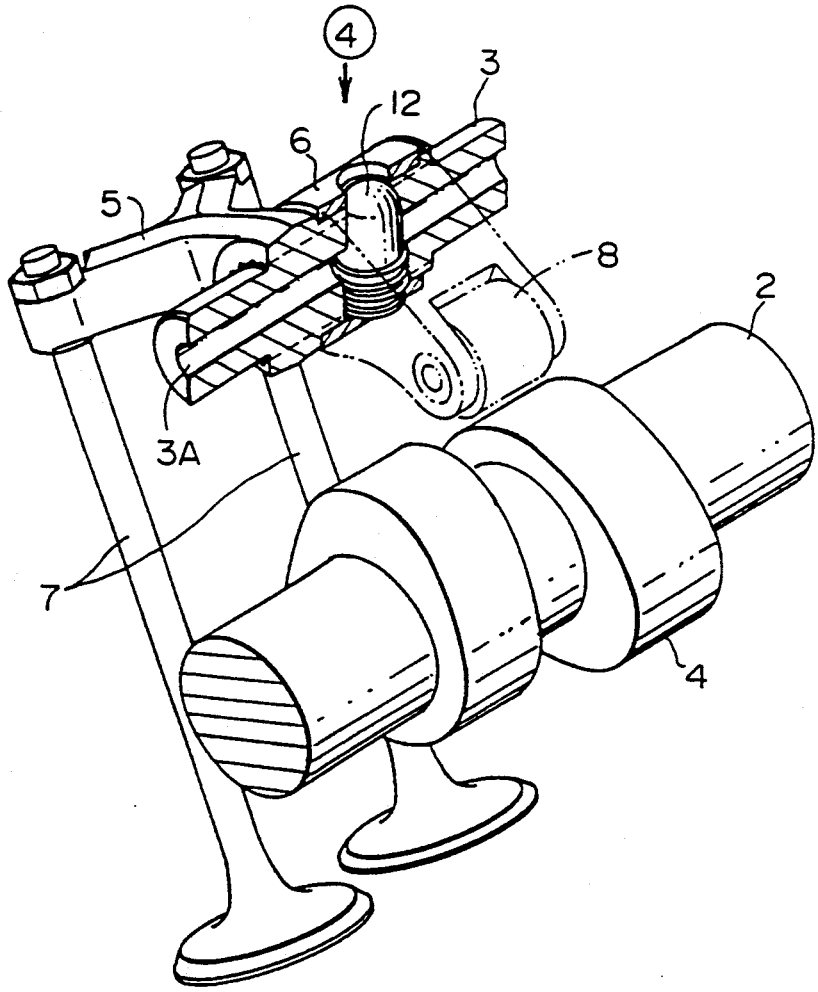
FIG. 3 is a perspective view, partially in cross section, of a valve system applied to an OHC type engine.
Figure 4:
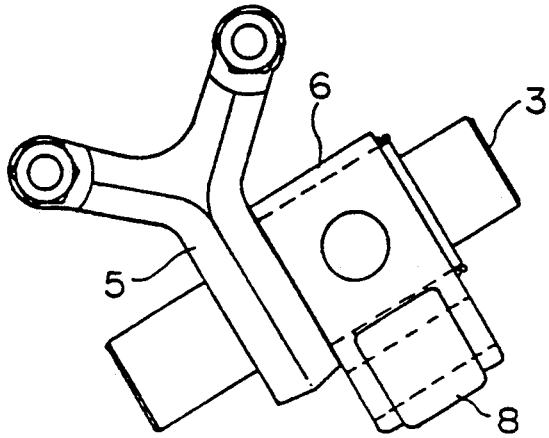
FIG. 4 is a plan view observed from the direction of FIG. 3.

The rocker shaft 3 includes a pair of main rocker arms 5, and a sub-rocker arm 6 disposed between the main rocker arms 5 as shown in FIG. 2.

A base of each main rocker arm 5 is coupled with the rocker shaft 3 by spline coupling, for example. The other end, i.e. rocking portion, of each main rocker arm is disposed against a stem end of an intake valve 7.

A base of the sub-rocker arm 6 is pivotally mounted on the rocker shaft 3. The sub-rocker arm 6 has a roller bearing 8 on its rocking portion.

Figure 5:
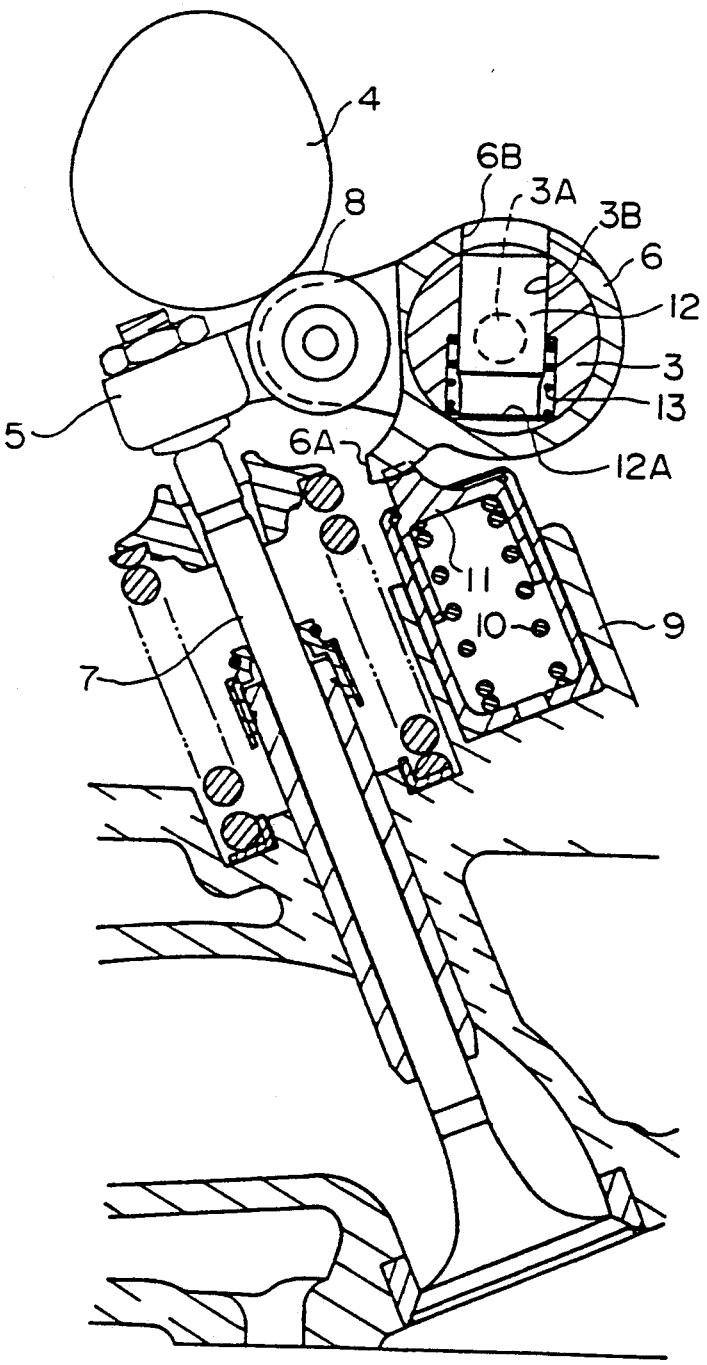
FIG. 5 is a cross-sectional view taken along (5)—(5) of FIG. 1.

As shown in FIG. 5, the rocking portion of the sub-rocker arm 6 has an arm portion 6A besides the portion for supporting the roller bearing 8. The arm 6A is in contact with a plunger 11 at an end of a lost motion spring 10 mounted on a cylinder head 9, and is biased to be movable clockwise as shown in FIG. 5, thereby causing the roller bearing 8 to come into pressure contact with the valve driving cam 4.

The sub-rocker arm 6 has an opening 6B on its circumferential surface. The opening 6B serves as a path in which a coupling plunger, to be described later, moves upwardly and downwardly.

Figure 6:
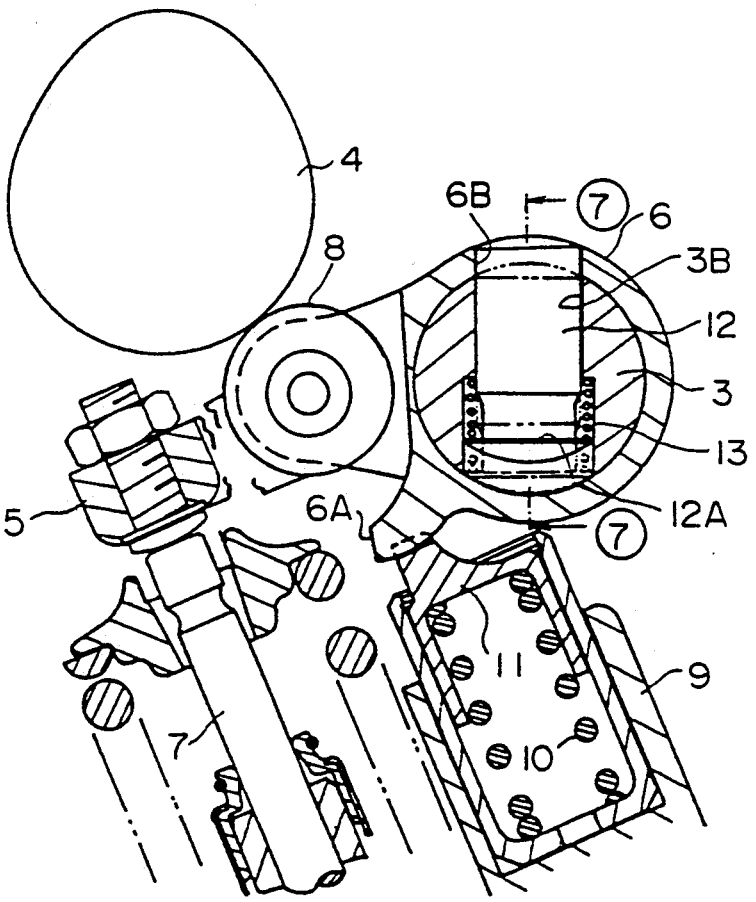
FIG. 6 is a cross-sectional view, in enlarged scale, of a main part of the structure shown in FIG. 5.
Figure 7:
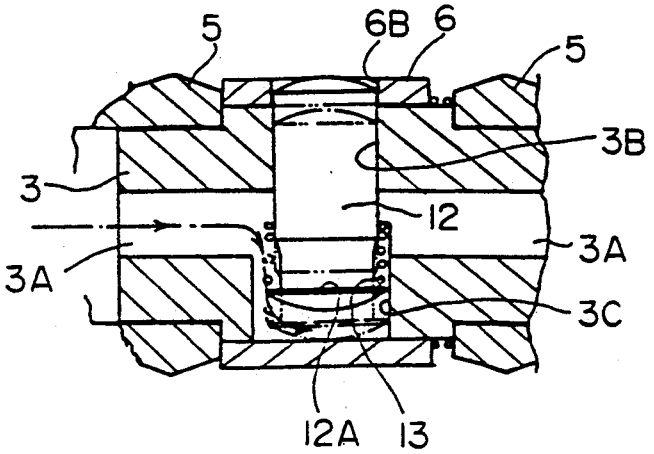
FIG. 7 is a cross-sectional view taken along line (7)—(7) of FIG. 6.

An oil gallery 3A is axially formed at the central portion in the rocker shaft 3 as shown in FIGS. 5 and 7. A through hole 3B is formed in the rocker shaft 3 at a position corresponding to the opening 6B of the sub-rocker arm, and is perpendicular to the oil gallery 3A. As shown in FIG. 6, the center of the through hole 3B and the center of the opening 6B coincide with each other when a base circle of the valve driving cam 4 comes into sliding contact with the roller bearing 8. The through hole 3B has a large diameter portion 3C, which communicates with the oil gallery 3A.

A coupling plunger 12 is located in the through hole 3B to be movable to and from the opening 6B.

As shown in FIG. 5, the coupling plunger 12 is normally given downward bias by a compression spring 3 so that a head thereof is in the through hole 3B. The compression spring 13 is positioned in the through hole 3B between a flange 12A at the bottom of the plunger 12 and a support in the rocker shaft 3.

In the foregoing embodiment, the opening 6B of the sub-rocker arm, through hole 3B of the rocker shaft, plunger 12 and compression spring 13 constitute first engaging means.

Figure 8:
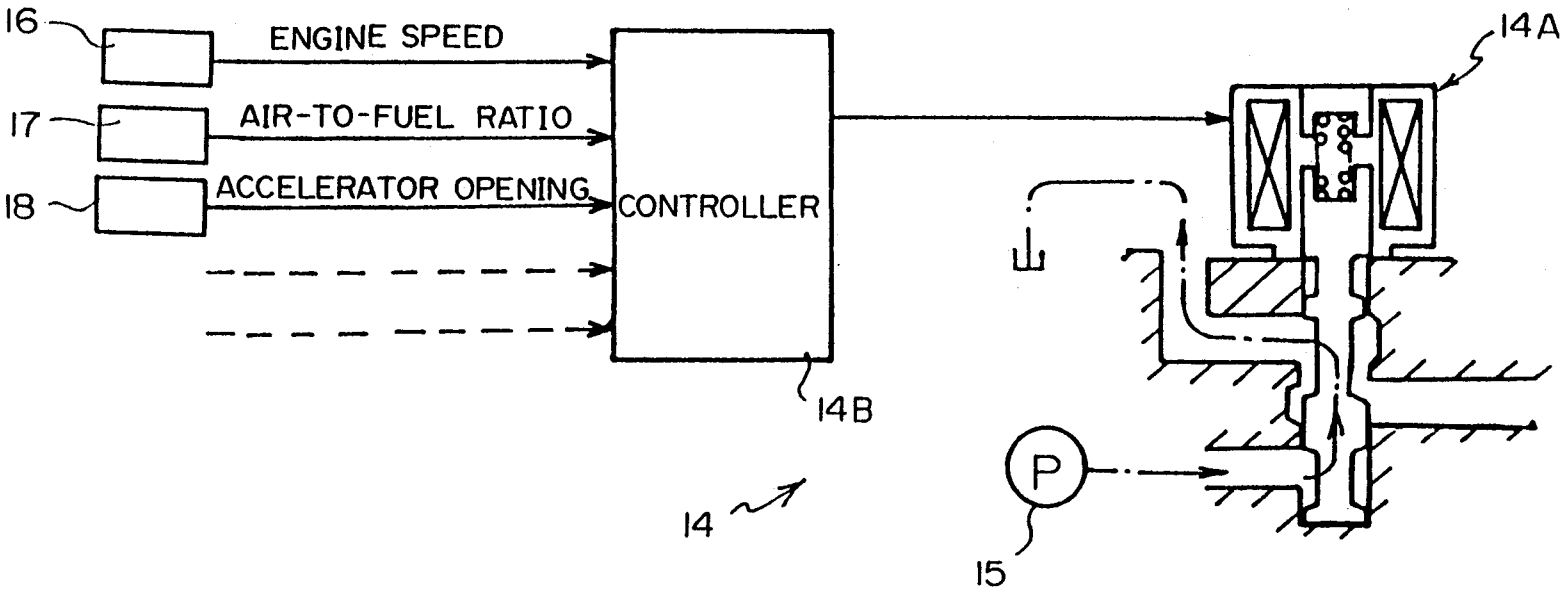
FIGS. 8 and 9 are block diagrams showing configurations of oil pressure controllers used for the main part of the valve system of FIG. 1.
Figure 9:
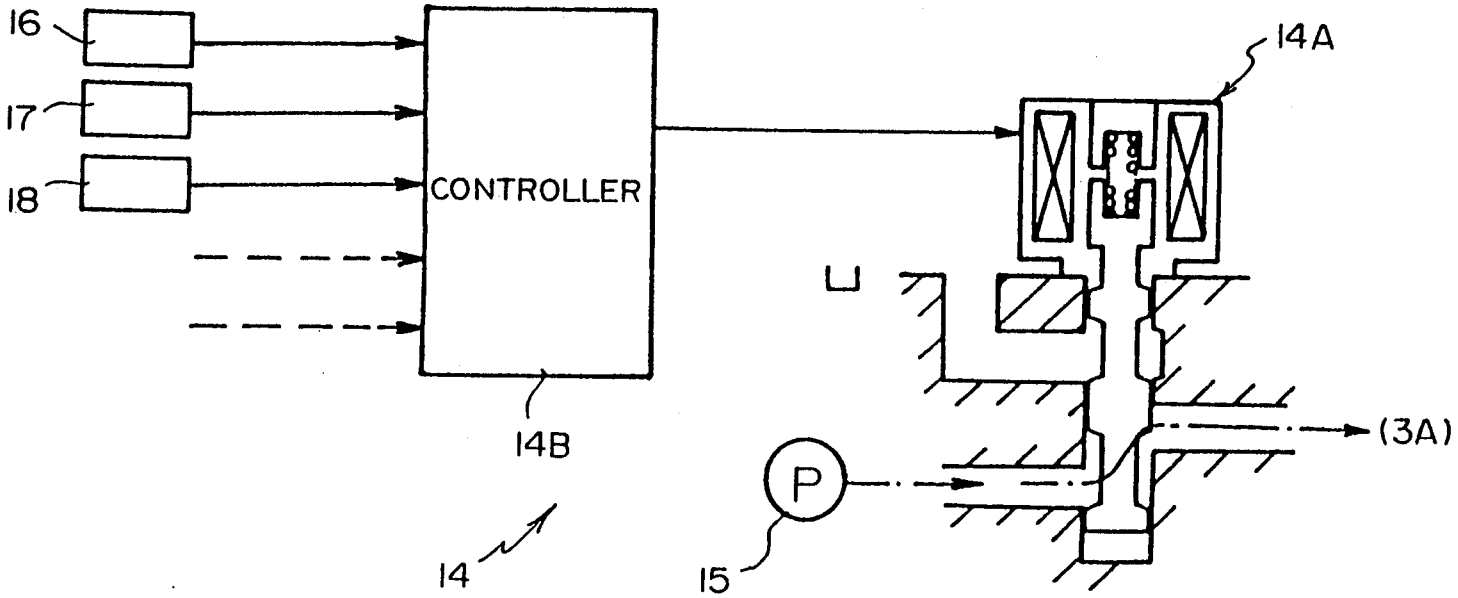

An output path of the oil pressure controller 14 is connected to the oil gallery 3A of the rocker shaft 3 as shown in FIG. 8.

The oil pressure controller 14 controls the pressure in the oil gallery 3A according to a running condition of the automobile, and includes electromagnetic solenoid valves 14A and control units 14B as a main part.

Each solenoid valve 14A has three paths, i.e. a path from an oil pump 15, a feedback path having an atmospheric pressure, and a path to the oil gallery 3A in the sub-rocker shaft 3. Under the normal condition, i.e. when it is not activated, the solenoid valve 14A is at a first position to introduce oil to the feedback path from the oil gallery 3A. The solenoid valve 14A associated with the high speed running condition is omitted in FIG. 8.

Since the pressure in the oil gallery 3A is kept low, the coupling plunger 12 remains away from the opening 6B by the bias of the compression spring 13 as shown in FIG. 5.

The control unit 14B comprises a micro computer, for example. An engine speed sensor 16, an $O_2$ sensor 17 for detecting an air-to-fuel ratio, and running condition detecting sensors including a throttle position sensor 18 are connected to input units of the control unit 14B. The control unit 14B discriminates the low or high speed running, and load according to data inputted by these sensors, and outputs driving signals to the solenoid valves 14A.

When one of the solenoid valves 14A is activated to take a second position, oil is supplied from the oil pump 15 to the oil gallery 3A to raise the pressure in the oil gallery 3A.

In the foregoing embodiment, the oil gallery 3A, oil pump 17 and oil pressure setting means 14 constitute driving means.

When the oil pressure controller 14 identifies that input data such as the engine speed, air-to-fuel ratio and accelerator opening satisfy the requirements for driving the air-intake valves 7, one of the solenoid valves 14A is activated. When it is activated, the solenoid valve 14A is switched from the position shown in FIG. 8 to the position shown in FIG. 9 to introduce the pressured oil to the oil gallery 3A from the oil pump 15, thereby raising the pressure in the oil gallery 3A.

Under this condition, oil flows from the oil gallery 3A to the large diameter portion 3C of the through hole 3B and around the flange 12A, finally reaching the lower surface of the flange 12A. Therefore, the coupling plunger 12 which is normally at the position shown by the double-dot-and-dash line in FIGS. 6 and 7, is pushed upwardly to reach the position where the head of the coupling plunger 12 projects in the opening 6B of the sub-rocker arm 6, as shown by the solid line in FIGS. 6 and 7. Thus, the rocker shaft 3 and the sub-rocker arm 6 are coupled.

The sub-rocker arm 6 is driven by the valve driving cam 4 to transmit the driving force to the main rocker arm 5 via the rocker shaft 3, thereby reciprocating the intake valves 7.

The rocker shaft 3 controls transmission of the driving force from the ca 4 to the main rocker arm 5 in order to drive the valves.

In the foregoing embodiment, the mechanism for controlling transmission of the driving force is located between the rocker shaft 3 and the sub-rocker arm 6 so that the valve system is applicable to either a DOHC or OHC type engine, thereby allowing the valve system to be designed more freely. Further, the coupling plunger is designed to make upward or downward movement only when the roller bearing comes into contact with the base circle of the cam. Otherwise, the coupling plunger is made not to move, so that the driving force will not be transmitted or interrupted improperly.

In the foregoing description, it is assumed that the coupling plunger normally stays in the through hole of the rocker shaft. Otherwise, it is possible that the head of the coupling plunger is in the opening of the sub-rocker arm under the normal condition.

FIGS. 10 to 13 are cross-sectional view showing the coupling plunger whose head is normally in the opening of the sub-rocker arm.

Figure 10:
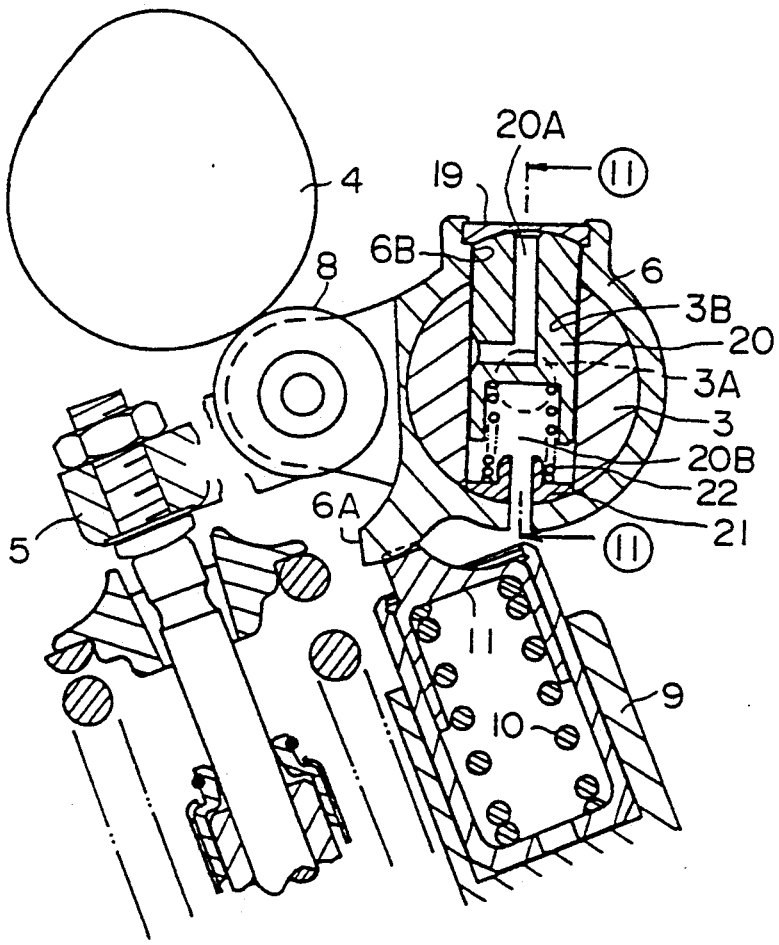
FIG. 10 is a cross-sectional view similar to FIG. 6, showing a modified example of the main part of FIG. 1.
Figure 11:
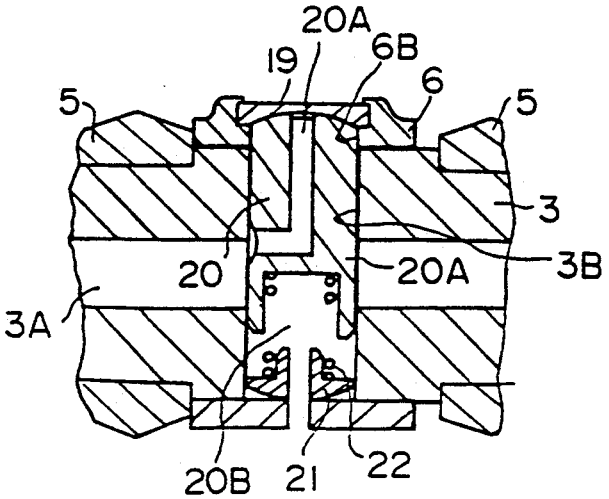
FIG. 11 is a cross-sectional view taken along line (11)—(11) of FIG. 10.
Figure 12:
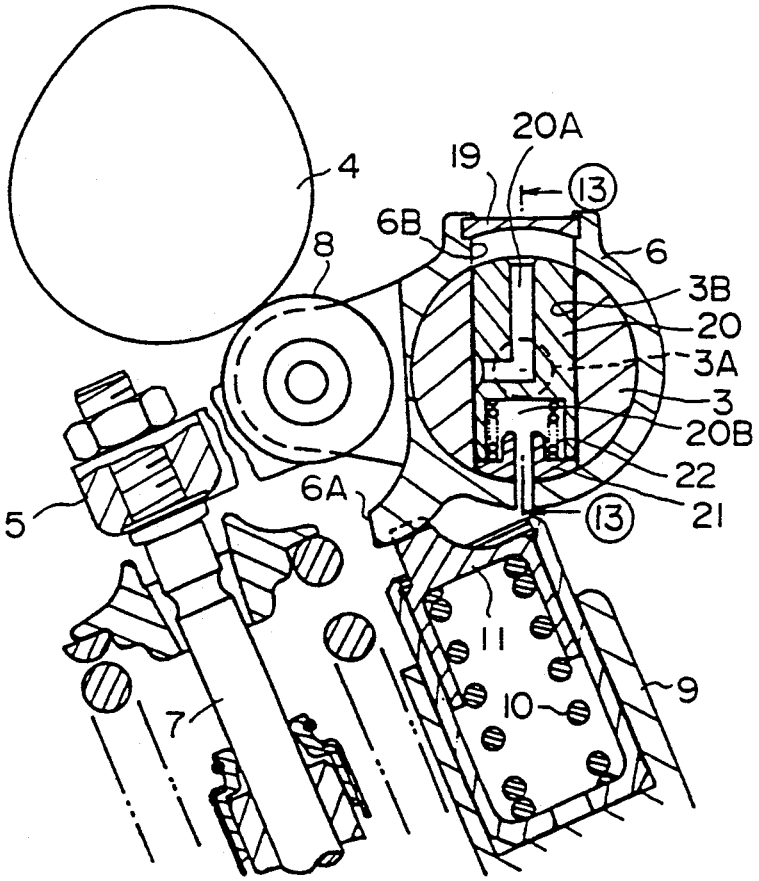
FIG. 12 is a cross-sectional view similar to FIG. 10, showing operation of a modified example.
Figure 13:
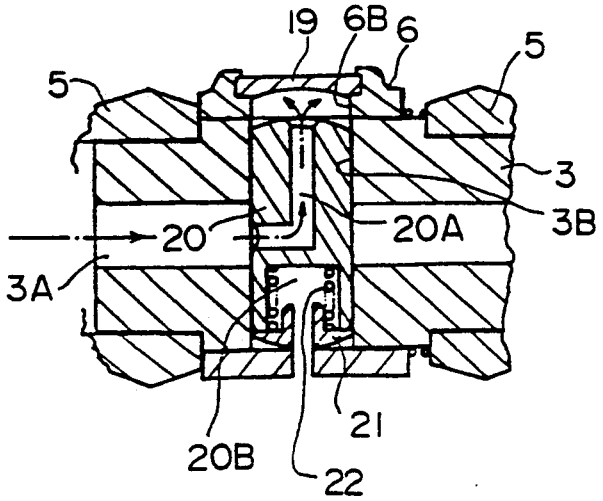
FIG. 13 is a cross-sectional view taking along line (13)—(13) of FIG. 12.

FIG. 10 is a view similar to FIG. 1. As shown in FIG. 10, the opening 6B is formed on the surface of the sub-rocker arm 6 at the position corresponding to the upper part of the through hole 3B. A receptor is formed at the upper end of the opening 6B, and is larger in diameter than the opening 6B. A cover 19 is fastened on the receptor by caulking.

The coupling plunger 20 has an oil path 20 A, one end of which communicates with the oil gallery 3A and the other end of which is open at the upper portion under the cover 19. Further, the coupling plunger 20 includes a cylindrical portion 20B at its bottom. The cylindrical portion 20B is open downwardly and is closed at the top. In the cylindrical portion 20B, the compression spring 22 is disposed on the spring receptor 21 attached on the inner circumferential surface of the rocker arm 6.

Therefore, the coupling plunger 20 is biased by the compression spring 22 to project its head to the opening 6B.

In FIG. 10, the holes on the sub-rocker arm 6 and the spring receptor 21 are for introducing air to compress and expand the compression spring 22.

In the first embodiment, the second engagement means comprises the opening 6B of the sub-rocker arm 6, through hole 3B of the rocker shaft 3, plunger 20 and compression spring 22.

With this arrangement, the coupling plunger 20 keeps its head in the opening 6B when the oil pressure in the oil gallery 3A is not increased. Therefore, the rocker shaft 3 and the sub-rocker arm 6 remain coupled and are driven by the cam to open and close the valves, and are receiving the driving force. The rocker shaft 3 and the sub-rocker shaft 6 assume this posture during the high or low speed running.

When the pressure in the oil gallery 3A is increased, the pressured oil is also supplied to the oil path 20A in the coupling plunger 20, and is discharged through the opening above the plunger 20, thereby lowering the plunger 20 against the bias of the compression spring 22. Then, the plunger 20 is moved to the position in which its head is in the through hole 3B, thereby interrupting the transmission of the driving force between the rocker shaft 3 and the sub-rocker arm 6.

Under this condition, since the main rocker arm is not driven by the driving cam, the sub-rocker arm associated with engine cylinders at rest is released during low load running.

A valve system according to a second embodiment of this invention will now be described with reference to FIGS. 14 to 25.

The valve system of this embodiment is characterized in that it includes a mechanism for controlling timing to open or close the valves during high or low speed running and for selectively stopping operation of valves during low speed running.

Figure 14:
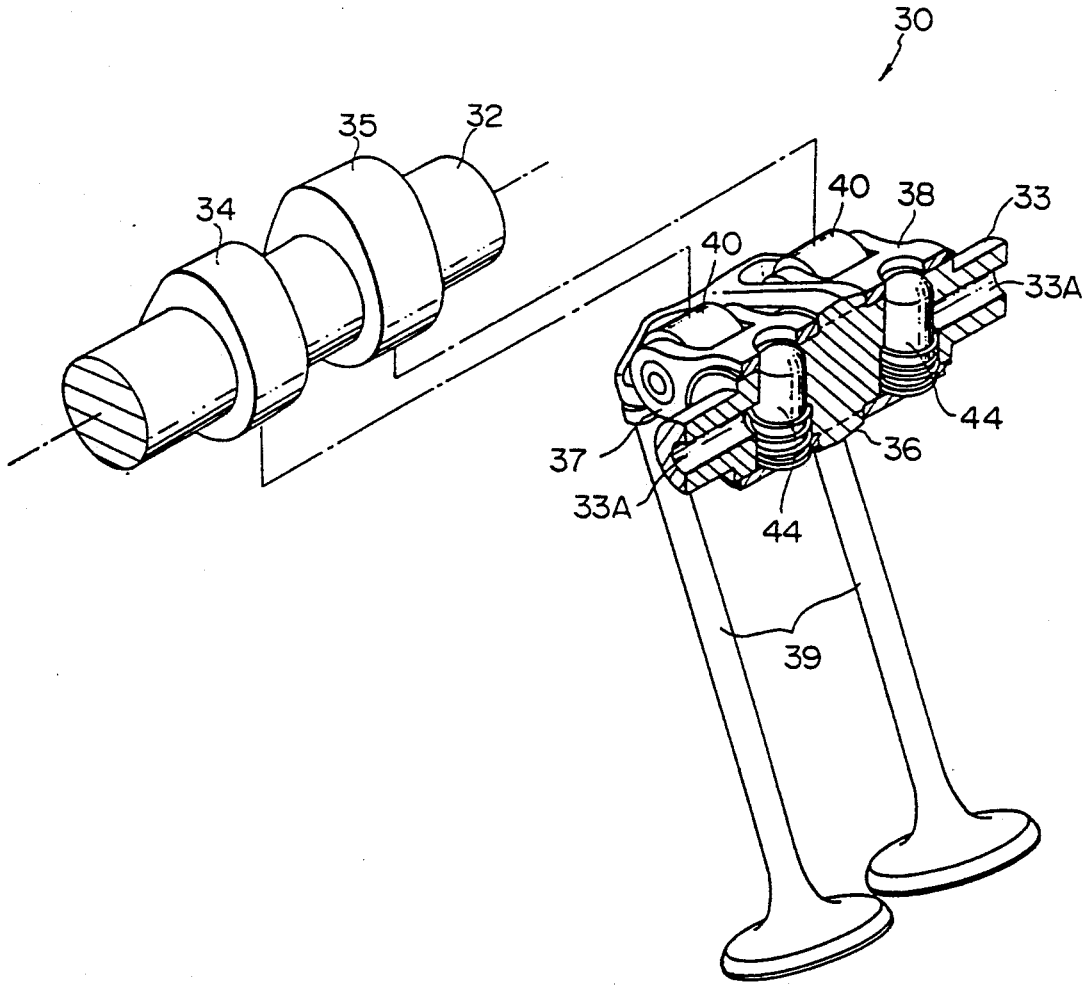
FIG. 14 is a perspective view, partially in cross section, of a valve system according to a second embodiment of this invention.

FIG. 14 shows the valve system 30 for a DOHC type engine. The valve system 30 comprises a camshaft 32 and a rocker shaft 33 which are pivotally supported on an engine housing. The camshaft 32 includes a low speed cam 34 having a small lift and a high speed cam 35 having a large lift, both of which are fixedly mounted on the camshaft 32.

The rocker shaft 33 includes a main rocker arm 36 and a pair of sub-rocker arms 37, 38.

The main rocker arm 36 is coupled with the rocker shaft 33 at its base by spline coupling, for example, and is in contact with valve stem ends of intake valves 39 at its other end (rocking portion), for example.

Figure 15:
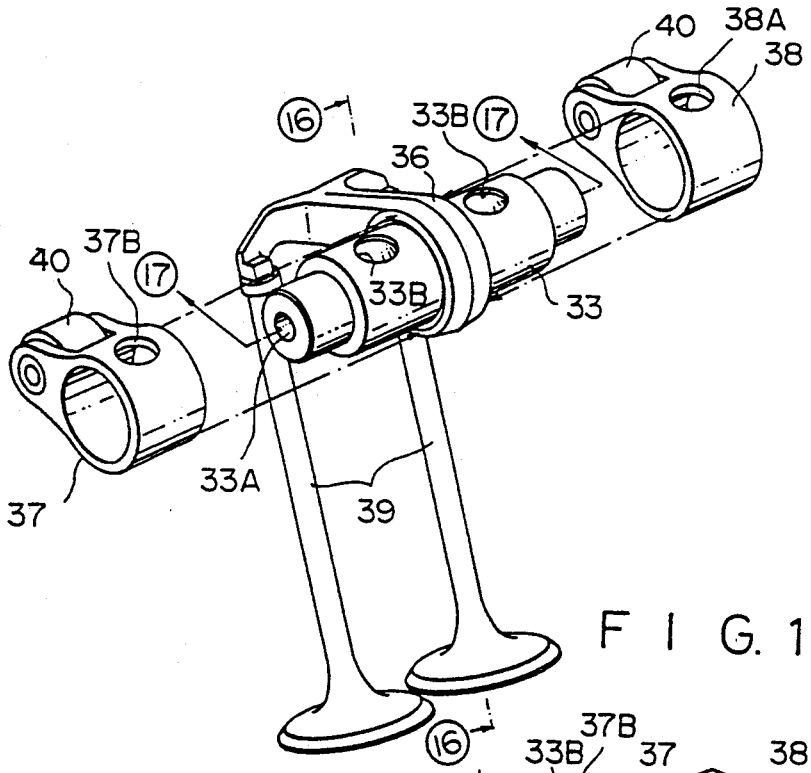
FIG. 15 is an exploded perspective view showing a main part of the valve system of FIG. 14.

As shown in FIG. 15, bases of the sub-rocker arms 37, 38 are pivotally mounted on the rocker shaft 33. Roller bearings 40 are mounted on the rocking portions of the sub-rocker arms 37, 38.

Figure 16:
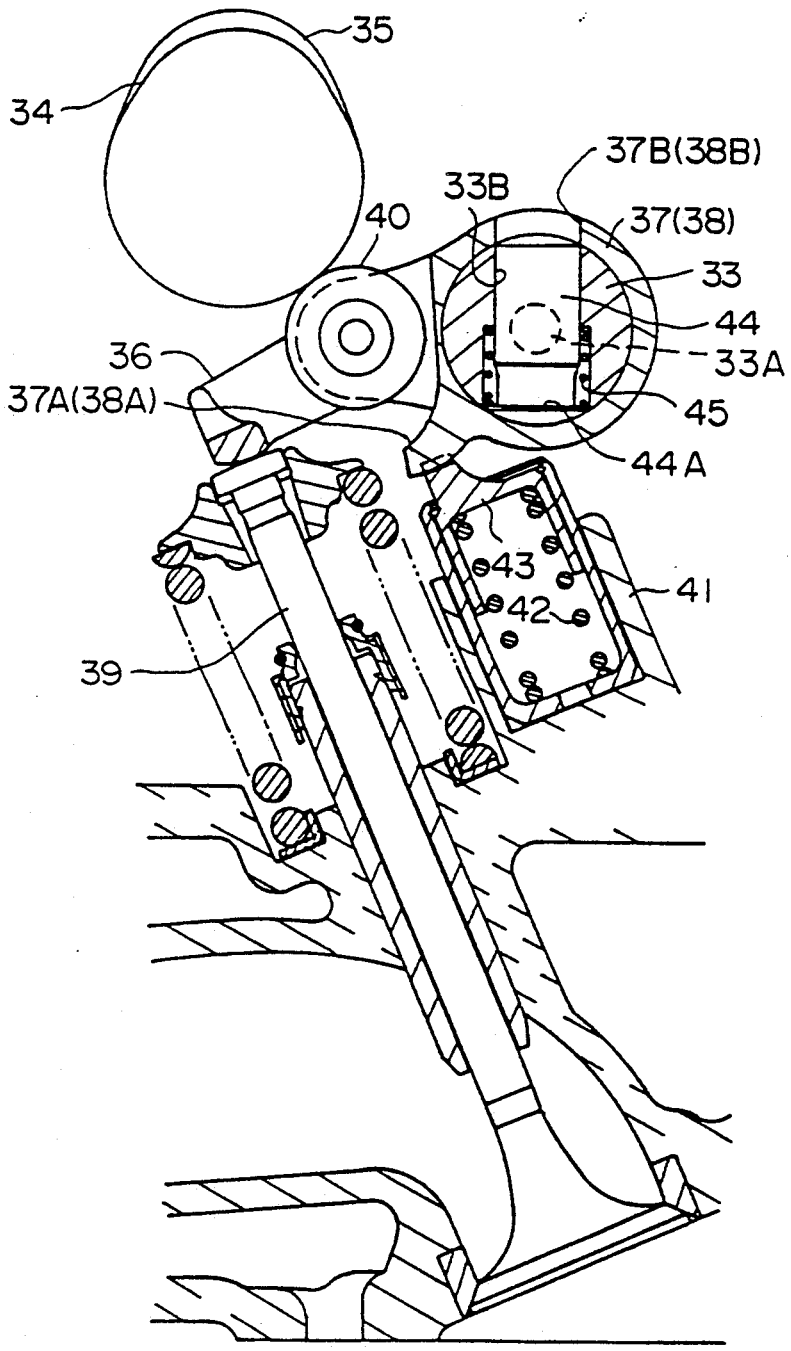
FIG. 16 is a cross-sectional view taken along line (16)—(16) of FIG. 15.

The rocking portions of the sub-rocker arms 37, 38 have arm portions 37A, 38A besides the supports for the roller bearings 40. The arm portion 37A is in contact with a plunger 42 at the end of the lost motion spring 42 of the cylinder head 41, and is biased to move clockwise as shown in FIG. 16, thereby causing the roller bearing 40 to come into pressure contact with the cam.

Figure 17:
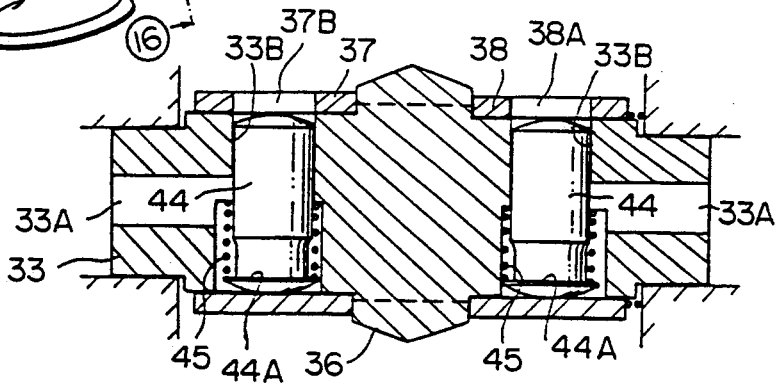
FIG. 17 is a cross-sectional view taken along an axial direction of a rocker shaft of FIG. 14.

The sub-rocker arms 37, 38 have openings 37B, 38B, respectively, on the outer circumferential surfaces thereof as shown in FIG. 17. In these openings 37B, 38B, coupling plungers, to be described later, are movable upwardly and downwardly.

As shown in FIG. 17, the oil gallery 33A is axially formed in the rocker shaft 33. In the oil gallery 33A, through holes 33B are formed at positions corresponding to the opening 37B, 38B, and are perpendicular to the oil gallery 33A as shown in FIG. 16. The through holes 33B are arranged so that they coincide with the holes 37B, 38B at the centers thereof when the base circles of the cams 34, 35 come into contact with the roller bearings 40.

The coupling plungers 44 are located in the through holes 33B to be movable into and from the opening 37B, 38B, respectively.

Normally, the coupling plungers 44 are downwardly biased by the compression springs 45, located between the bottom of the through holes 33B and support members in the rocker shaft 33, so that the head portions of the coupling plungers 44 are in the through holes 33B.

In the second embodiment, the openings 37B, 38B of the sub-rocker arms 37, 38, through holes 33B of the rocker shaft 33, plungers 44 and compression spring 45 constitute the first engaging means.

Figure 18:
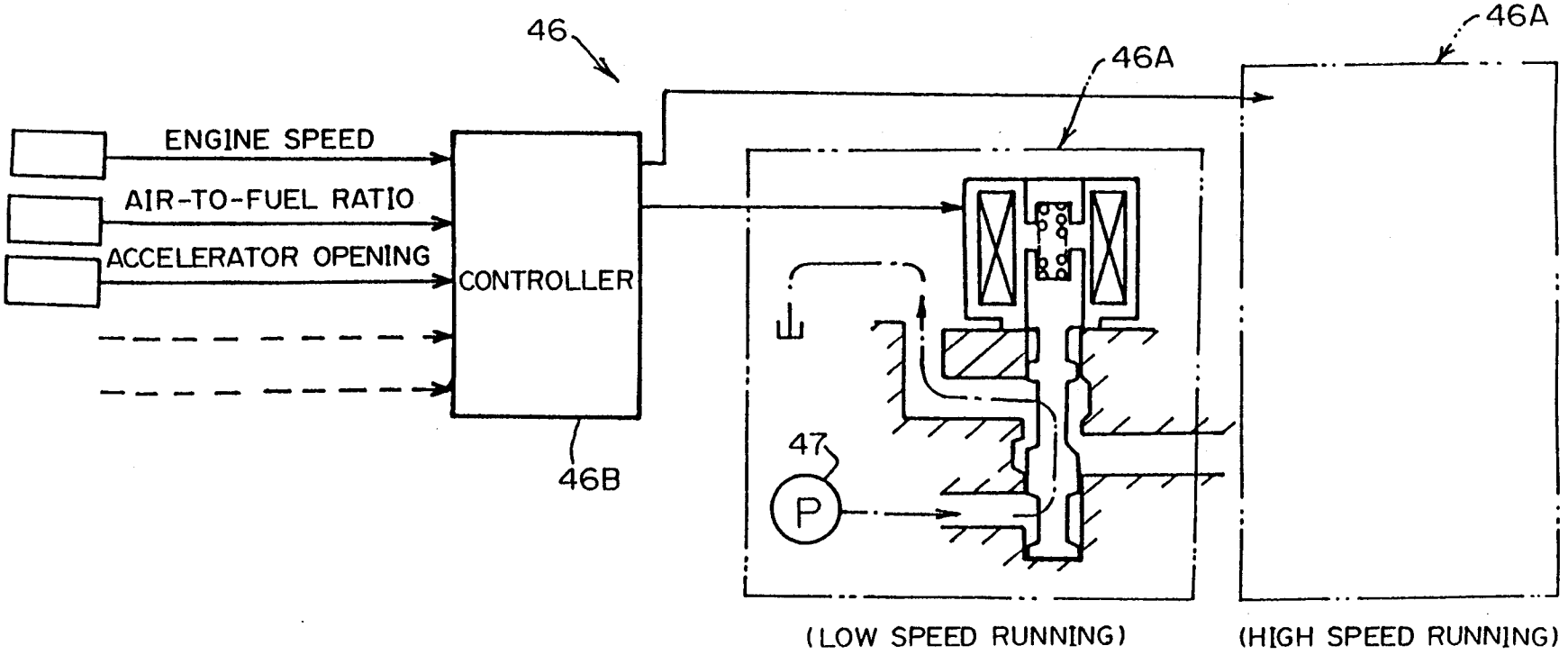
FIGS. 18 and 19 are block diagrams showing configurations of oil pressure controllers for the main parts shown in FIG. 14.

An output path of an oil pressure controller 46 shown in FIG. 18 is connected to the oil gallery 33A of the rocker shaft 33.

The oil pressure controller 46 controls the pressure in the oil gallery 33A according to the running condition of the automobile, and comprises electromagnetic solenoid valves 46A and control units 46B as main parts.

In this embodiment, the solenoid valves 46A are used for the high speed running and low speed running, respectively. Each of the valves 46A has a path from the oil pump 46, a feedback path having an atmospheric pressure, and a path to the oil gallery 33A in the rocker shaft 33. Normally, each solenoid valve 46A is set at a first position to introduce oil from the oil gallery 33A to the feedback path. The solenoid valve 46A for the high speed running is omitted in FIG. 18.

Therefore, since the pressure in the oil gallery 33A is kept low, the coupling plungers 44 are biased by the compression springs 45 to get free from the openings 37B, 38B.

The oil pressure controller 46B comprises a microcomputer, for example. An engine speed sensor 48, an $O_2$ sensor for detecting air-to-fuel ratio, and various sensors including a throttle position sensor 50 are connected to input units of the controller 46B. The controller 46B discriminates high or low speed running and load condition according to data inputted by these sensors, and outputs driving signals to one of the electromagnetic solenoid valves 46A, associated with the high and low speed running.

Therefore, when one of the solenoid valves 46A is activated and is at the second position, oil is supplied to the oil gallery 33A from the oil pump 47 to raise the pressure in the oil gallery 33A.

In the second embodiment, the oil gallery 33A and oil pump 47 and oil pressure controller 46 constitute the driving means.

With this arrangement, when the oil pressure controller 46B identifies relatively low speed running according to the engine speed, air-to-fuel ratio and accelerator opening, the solenoid valve 46A associated with the low speed running is activated while the valve 46B for the high speed running is kept at the normal position.

Figure 19:
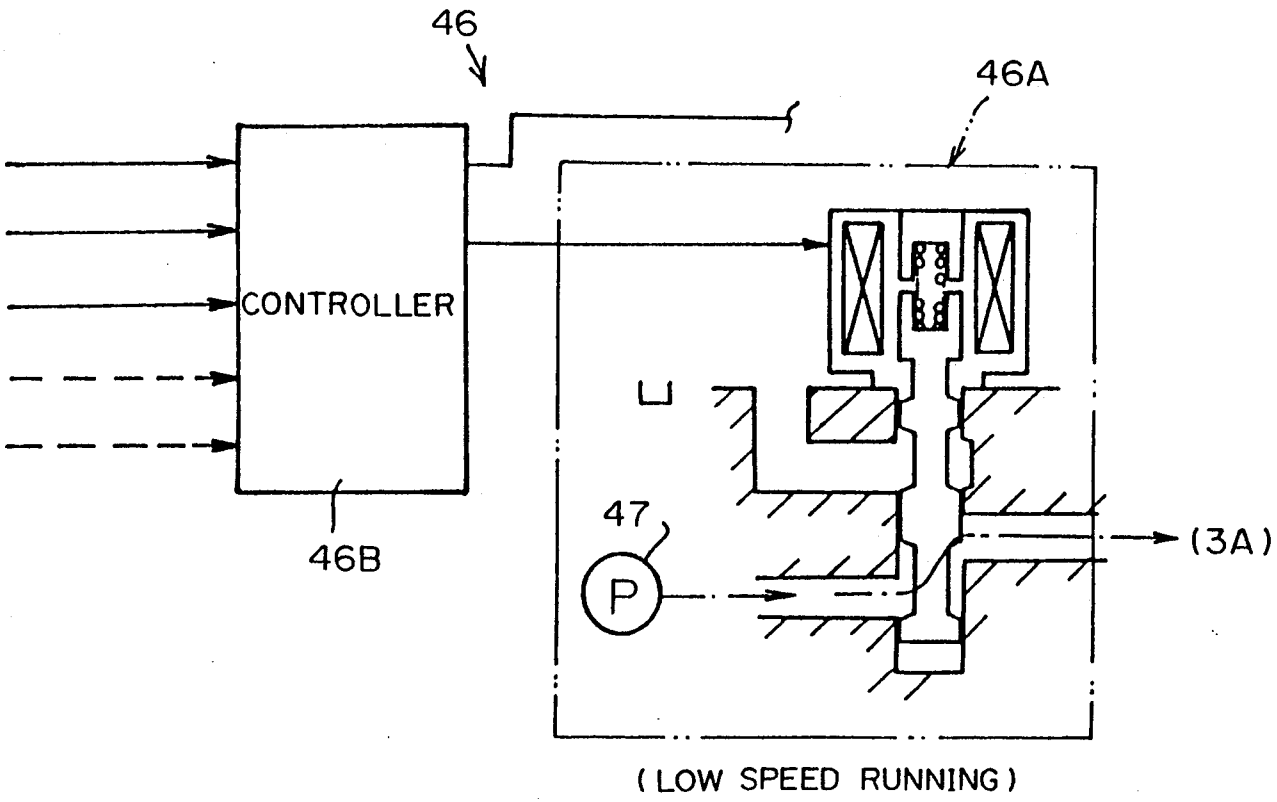
Figure 20:
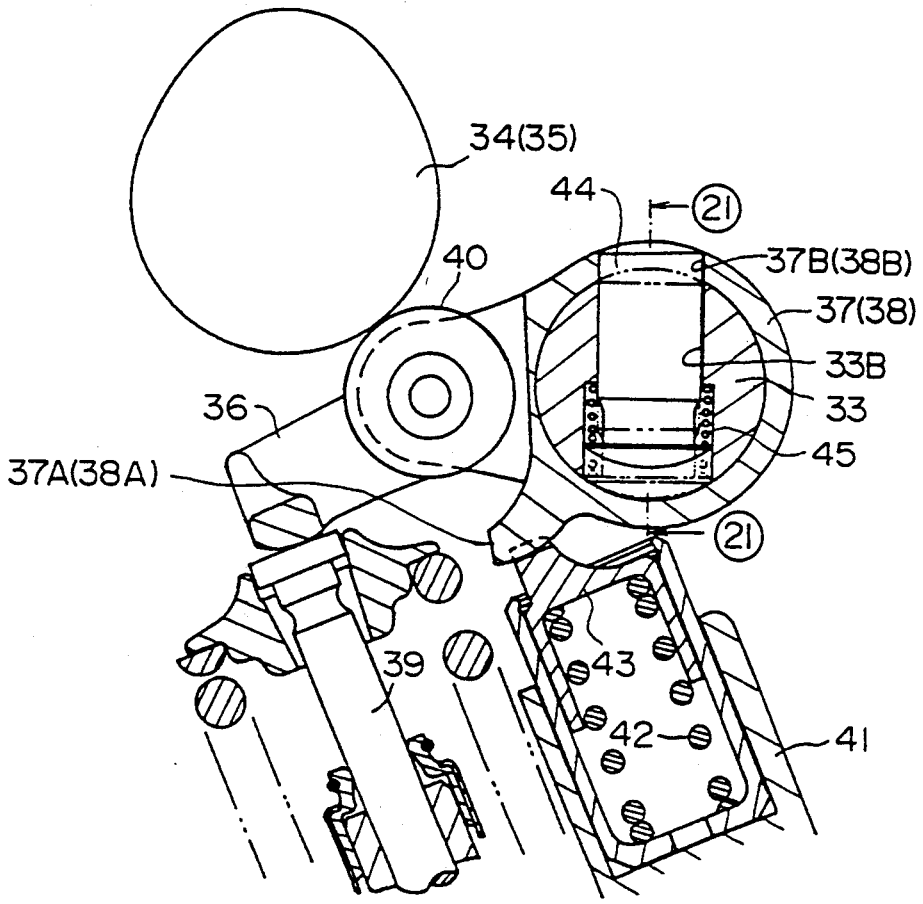
FIG. 20 is a cross-sectional view describing operation of the main parts of FIG. 14

When the solenoid valve 46A for the low speed running is activated, it is switched to the position (FIG. 19)

for supplying the pressured oil to the oil gallery 33A from the oil pump 47 as shown in FIG. 18. On the other hand, the other solenoid valve 46A for the high speed running is maintained at the initial position not to supply the oil to the oil gallery 33A.

Therefore, the coupling plunger 44 associated with the low speed running is operated a shown in FIGS. 6 and 7, and projects to the opening 37B of the first sub-rocker arm 37 against the bias of the compression spring 45 to couple the first sub-rocker arm 37 with the rocker shaft 33. Thus, driving force is transmitted between the sub-rocker arm 37 and the rocker shaft 33 to control the opening and closing of the valves in response to the movement of the cam 34 for the low speed running. The plunger 44 for the high speed side remains in the through hole 33B of the rocker shaft 33 as shown by double-dot line in FIG. 21. Transmission of the driving force is interrupted between the second sub-rocker arm 38 and the rocker shaft 33 associated with the high speed running so that the high speed cam 35 does not control the valves.

When the engine speed is increased to reach a high speed range, the solenoid valve 46A for the high speed side is activated. In this case, the plunger 44 for the high speed side projects to the opening 38B of the second sub-rocker arm 38 as shown by the solid line in FIG. 21. Then, the rocker shaft 33 and the second sub-rocker arm 38 are coupled so that the driving force can be transmitted between them. The plunger 44 for the low speed side is disengaged from the opening 37B of the first sub-rocker arm 37, and moves into the through hole 33B of the rocker shaft 33.

Thereafter, the valves are controlled by the cam 35 for the high speed running.

When the automobile is detected to be running under a low load as well as at a low speed based on data inputted by the throttle position sensor, the cams are made not to control the valves associated with engine cylinders which are selected to be placed in a standby mode. In other words, the controller 46B releases activation of the solenoid valves 46A.

Since the solenoid valves 46A do not assume the position to supply the pressured oil, the pressure is not raised in the oil gallery 33A of the rocker shaft 33, so that the coupling plungers 44 are biased by the compression springs 45 to stay in the through holes 33B as usual. No driving force is transmitted between the first and second sub-rocker arms 37, 38 and the rocker shaft 33.

Therefore, the sub-rocker arms 37, 38 are not controlled by the movement of the cams 34, 35, and valves are stopped, so that some cylinders are in the standby mode. This standby mode is switched to the operation mode in which the plungers 44 assumes a position depending upon the engine speed when the low load condition is canceled.

According to the second embodiment, during the high speed running, transmission of the driving force to the sub-rocker arm for the low speed running can be interrupted. In other words, since the sub-rocker arms are not operated, driving torque can be decreased, and the valves can be opened and closed more efficiently during the high speed running.

In the foregoing description, it is assumed that the coupling plungers are normally in the through holes of the rocker shaft. It is also possible that the heads of the coupling plungers are normally engaged in the openings of the sub-rocker arms as shown in FIGS. 10 to 13.

FIGS. 22 to 29 show the coupling plungers whose heads are normally engaged in the openings of the sub-rocker arms. In FIGS. 22 to 29, the components identical to those in FIGS. 14 to 21 are assigned the same reference numerals.

Figure 21:
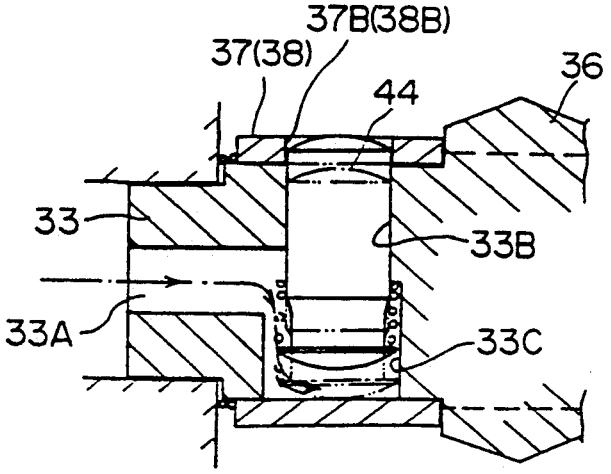
FIG. 21 is a cross-sectional view taken along line (21)—(21) of FIG. 20.
Figure 22:
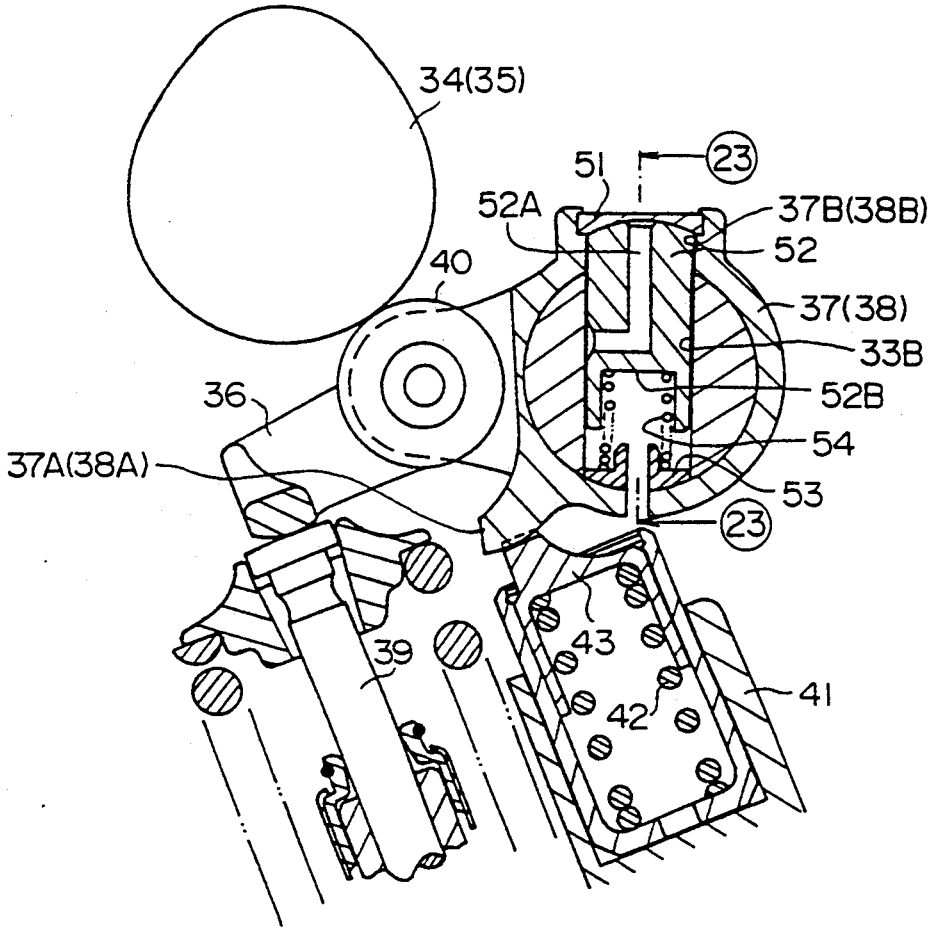
FIG. 22 is a view similar to FIG. 20 showing a modified example of the main part of FIG. 14.

FIG. 22 is a cross-sectional view showing a structure for pivotally supporting the first sub-rocker arm 37. As shown in FIG. 21, an opening 37B is formed at a position on the circumferential surface of the first sub-rocker arm 37 above the through hole 33B. A receptor is located at the upper portion of the opening 37B and is larger in diameter than the opening 37B. A cover 51 is attached on the receptor by caulking.

The plunger 52 has an oil path 52A, one end of which communicates with the oil gallery 33A and the other end of which opens at the cover 51, and a cylindrical member 52B which is closed at the top and is open at the bottom. A compression spring 54 is located in the cylindrical member 52B at a position above a spring receiver 53 mounted on the inner circumferential surface of the first sub-rocker arm 37.

Therefore, the plunger 52 is biased by the compression spring 54 to project its head toward the opening 37B.

In FIG. 22, holes on the spring receiver 53 and the sub-rocker arm 37 communicate with the atmosphere to enable contraction and expansion of the compression spring 54.

In the second embodiment, the second engaging means comprises the opening 37B of the sub-rocker arm, through hole 33B of the rocker shaft 33, plunger 52 and compression spring 54.

Figure 23:
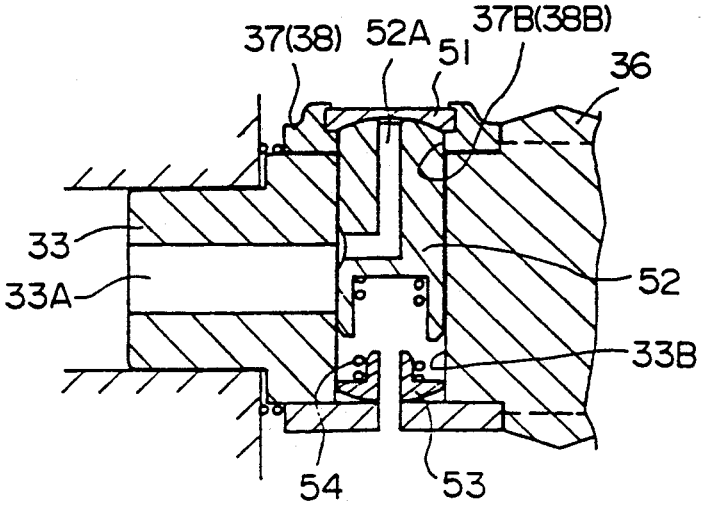
FIG. 23 is a cross-sectional view taken along line (23)—(23) of FIG. 22.
Figure 24:
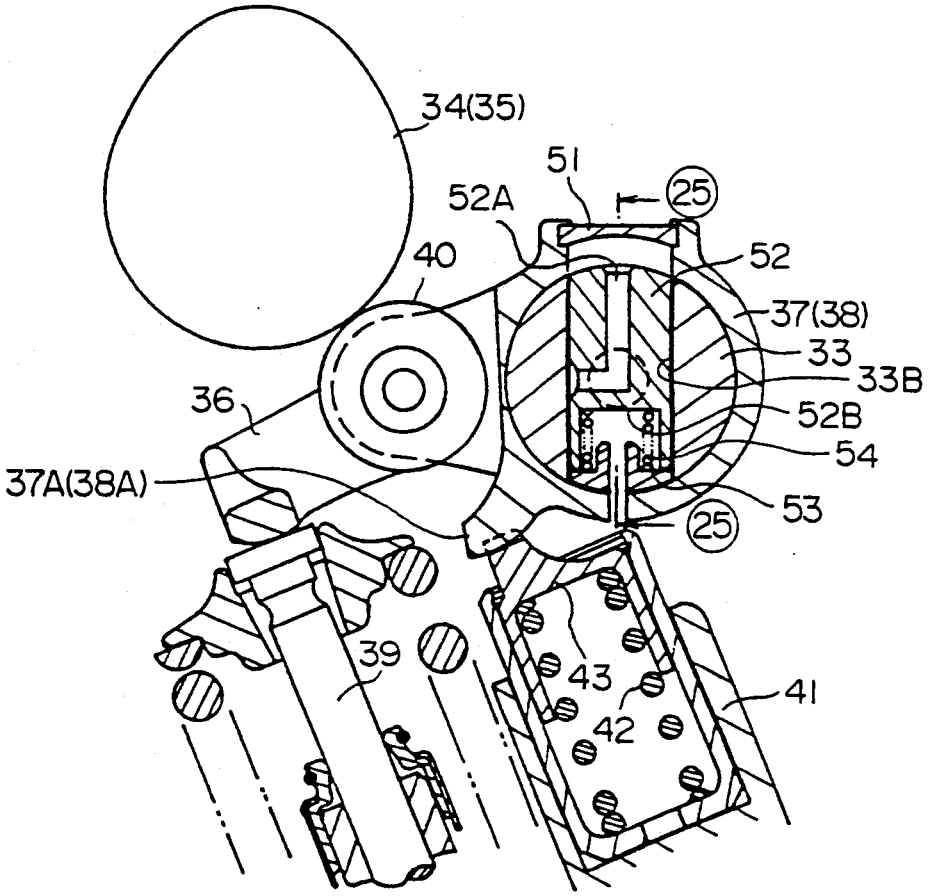
FIG. 24 is a view similar to FIG. 22 showing operation of a modified example.
Figure 25:
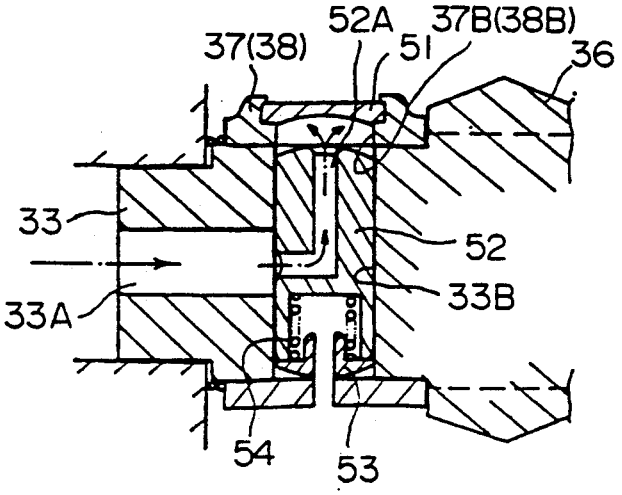
FIG. 25 is a cross-sectional view taken along line (25)—(25) of FIG. 22.
Figure 26:
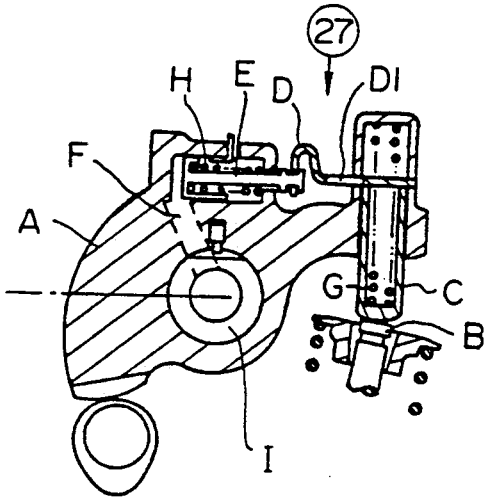
FIG. 26 is a cross-sectional view showing a structure of a conventional valve system.
Figure 27:
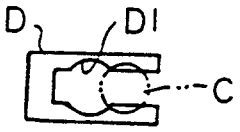
FIG. 27 is a cross-sectional view observed from the direction (27) of FIG. 26.
Figure 28:
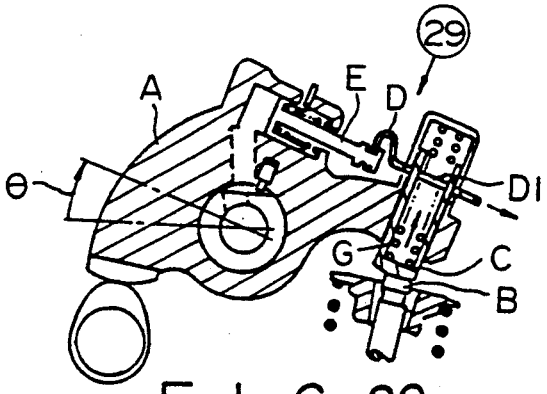
FIG. 28 is a cross-sectional view similar to FIG. 26, showing operation of the valve system of FIG. 26.
Figure 29:
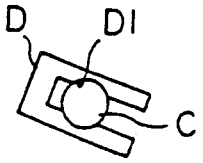
FIG. 29 is a cross-sectional view observed from the direction (29) of FIG. 28.

With this arrangement, when the pressure is not raised in the oil gallery 33A as shown in FIGS. 22 and 23, the coupling plunger 52 is engaged with the hole 37B by its head. Since the rocker shaft 33 is coupled with the first sub-rocker arm 37 and is rocked in response to the movement of the cam to open and close the valves, the driving force can be transmitted between the rocker shaft 33 and the sub-rocker arm 37 to permit the automobile to run at a low or high speed.

When the oil pressure is raised in the oil gallery 33A, the pressured oil is also supplied to the oil path 52A in the coupling plunger 52, and is discharged through the opening at the top of the plunger 52. Therefore, the plunger 52 is moved downwardly against the bias of the compression spring 54, shifting its normal position to the position where its head is moved into the through hole 33B. Thereafter transmission of the driving force is interrupted between the rocker shaft 33 and the first sub-rocker arm 37. The sub-rocker arm is not driven in response to the movement of the cam.

Under this condition, (a) the sub-rocker arm 38 and main rocker arm 36 for the high speed running are disengaged from each other during the low speed running, (2) the sub-rocker arm 37 and main rocker arm 36 for the low speed running are disengaged from each other during the high speed running, or (3) the sub-rocker arms and main rocker arms associated with cylinders at rest are disengaged from one another.

What is claimed is:

1. A valve system for an automobile engine, comprising:

(a) a camshaft;

(b) a plurality of valves for opening and closing intake ports of engine cylinders;

(c) a cam mounted on said camshaft for driving said valves;

(d) a rocker shaft pivotally mounted on an engaging housing and disposed adjacent to said camshaft;

(e) a main rocker arm fixedly mounted on said rocker shaft, one end of said main rocker arm being disposed against stems of said valves;

(f) a sub-rocker arm pivotally mounted on said rocker shaft, one end of said sub-rocker arm being normally biased to be in sliding contact with said cam by a biasing means, and said sub-rocker arm being rockable in response to movement of said cam;

(g) engaging means for engaging and disengaging said rocker shaft with and from said sub-rocker; and (h) driving means for driving said engaging means depending upon an operating condition of the engine to engage and disengage said rocker shaft with and from said sub-rocker arm.

2. A valve system according to claim 1, wherein said camshaft includes a low speed cam and a high speed cam having different profiles, and said sub-rocker arm includes a low speed rocker arm being rockable in response to the movement of said low speed cam and a high speed rocker arm being rockable in response to the movement of said high speed cam.

3. A valve system according to claim 2, wherein at a high engine speed, said engaging means engages said high speed rocker arm with said rocker shaft to drive said valves in response to the movement of said high speed cam, at a low engine speed, said engaging means engages said low speed rocker arm with said rocker shaft and disengages said high speed rocker arm from said rocker shaft to drive said valves in response to the movement of said low speed cam, and at a low engine speed and low load, said engaging means disengages said high speed rocker arm and said low speed rocker arm from said rocker shaft to stop said valves.

4. A valve system according to claim 1, wherein said engaging means includes an engaging hole which is on a rotating surface of said sub-rocker arm for angularly moving said rocker shaft, a through hole which is in said rocker shaft and is perpendicular to the axial direction of said rocker shaft and of which central axis coincides with the central axis of said engaging hole when a base circle of said cam is in sliding contact with said sub-rocker arm, and a plunger which is movable between a position in said through hole and a position projecting in said engaging hole and is engaged in said engaging hole when both of said central axes are in agreement, and said driving means includes an oil gallery in said rocker shaft in the axial direction thereof, and oil pressuring means for applying oil pressure to said plunger via said oil gallery to operate said plunger and to engage and disengage said rocker shaft with and from said sub-rocker arm.

5. A valve system according to claim 4, wherein said engaging means further includes a large diameter portion of said through hole of said rocker shaft, said large diameter portion being located near the bottom of said through hole and being larger in diameter than said engaging hole of said sub-rocker arm, a flange mounted on said plunger at a position opposite to said engaging hole and being movable in said large diameter portion of said through hole of said rocker shaft, a convex member located at the bottom of said plunger, and a spring mounted around said plunger in a space between said flange and said large diameter portion and adapted to bias said plunger to keep said flange in said large diameter portion of said through hole. and said driving means further includes an oil chamber located in said large diameter portion of said through hole of said rocker shaft, and an oil path of said flange, said oil being to introduce oil from said oil gallery to said oil chamber.

6. A valve system according to claim 4, wherein said engaging means further includes a spring mounted round said plunger at an end opposite to said engaging hole and adapted to bias said plunger to project said plunger into said engaging hole, and said driving means further includes an oil passage which is located in said plunger and has an end open at an upper portion of said plunger and the other end open on a side of said plunger to introduce oil from said oil gallery to a space between said engaging hole and a surface of said plunger in said engaging hole.

7. A valve system according to claim 4, wherein said oil pressure means includes a pressure oil pump for generating high pressure oil;

a path for supplying the high pressure oil to said oil gallery in said rocker shaft, an oil pressure controller located in said high pressure oil supplying path to supply and interrupt oil to and from said oil gallery, and a relief valve for releasing pressure of oil when oil pressure in said high pressure oil supplying path between said oil pressure controller and said pressure oil pump exceeds a predetermined value.

8. A valve system according to claim 7, wherein said oil pressure controller comprises a solenoid valve for selecting a first position for supplying the high pressure oil from said pressure oil pump to said oil gallery or a second position for connecting said oil gallery to a low pressure oil tank, a solenoid for activating said solenoid valve to select any of said two positions, and a computer for operating said solenoid according to an engine speed and load.

9. A valve system according to claim 1, wherein said sub-rocker arm has at its one end a roller bearing which is in sliding contact with said cam.

* * * * *